US010144048B2

(12) United States Patent
Kiridena et al.

(10) Patent No.: US 10,144,048 B2
(45) Date of Patent: Dec. 4, 2018

(54) HIGH STIFFNESS AND HIGH ACCESS FORMING TOOL FOR INCREMENTAL SHEET FORMING

(71) Applicant: Ford Global Technologies, LLC, Dearborn, MI (US)

(72) Inventors: Vijitha Senaka Kiridena, Ann Arbor, MI (US); Zhiyong Cedric Xia, Canton, MI (US); Feng Ren, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 273 days.

(21) Appl. No.: 14/547,415

(22) Filed: Nov. 19, 2014

(65) Prior Publication Data

US 2016/0136714 A1 May 19, 2016

(51) Int. Cl.
*B21D 31/00* (2006.01)

(52) U.S. Cl.
CPC ..... *B21D 31/005* (2013.01)

(58) Field of Classification Search
CPC ..... B21D 3/02; B21D 22/14; B21D 22/16; B21D 22/18; B21D 22/185; B21D 31/00; B21D 31/005; B21D 39/14; B21D 19/043; B21D 39/10; B21D 39/12; B21D 39/18
USPC ..... 72/75, 112, 114, 115, 124–126, 83, 85
See application file for complete search history.

(56) References Cited

U.S. PATENT DOCUMENTS 1,922,087 A * 8/1933 Hiester ..... B21D 22/16 72/115
1,922,088 A * 8/1933 Hiester ..... B21D 22/16 72/115
1,968,296 A * 7/1934 Hiester ..... B21D 22/16 72/115

(Continued)

FOREIGN PATENT DOCUMENTS

DE 102013019397 A1 * 5/2015 ..... B21D 31/005
EP 1462190 A1 9/2003

(Continued)

OTHER PUBLICATIONS

Translation of DE 10 2013 019 397 A1, Weise Dieter, pp. 1-20, translated on Nov. 3, 2016.*

(Continued)

*Primary Examiner* — Teresa M Ekiert
(74) *Attorney, Agent, or Firm* — LeClairRyan

(57) ABSTRACT

An tool for the incremental forming of material sheeting is disclosed. The tool comprises a forming tip, a shank, and an interface adapter positioned between the forming tip and the shank. The forming tip has a diameter and the shank has a diameter. The diameter of the forming tip is greater than the diameter of the shank. The forming tip may be of a variety of configurations. The forming tip may be donut-shaped. The donut-shaped tip may have a recessed area formed therein. The recessed area may be frustoconically shaped. As an alternative to the forming tip being donut-shaped, the forming tip may be made up of at least two forming spheres. An adapter is provided to which the spheres may be attached either directly or by arms. The diameters of the spheres may be the same or may be different diameters.

4 Claims, 9 Drawing Sheets

(56) References Cited

U.S. PATENT DOCUMENTS 2,254,275 A * 9/1941 Dove ..... B21D 22/18 72/125
3,342,051 A 9/1967 Leszak
3,434,321 A * 3/1969 Morgan ..... B21D 22/16 72/476
3,477,264 A * 11/1969 Sohlemann ..... B21D 22/18 72/81
3,911,707 A * 10/1975 Minakov ..... B21D 39/14 72/75
4,802,355 A * 2/1989 Ezell ..... B21D 19/043 72/112
5,097,690 A * 3/1992 Adams ..... B21D 41/023 72/126
5,477,720 A * 12/1995 Lentz ..... B21D 19/046 72/124
7,188,398 B2 * 3/2007 Prevey ..... B23P 9/02 29/90.01
8,272,243 B2 * 9/2012 Hasegawa ..... B21D 19/043 29/243.5
8,302,442 B2 11/2012 Kiridena et al.
8,322,176 B2 12/2012 Johnson et al.
8,733,143 B2 5/2014 Kiridena et al.
2002/0079106 A1 * 6/2002 Simpson ..... B21D 39/10 72/119
2008/0236232 A1 * 10/2008 Hodjat ..... B21D 22/16 72/83
2013/0312473 A1 * 11/2013 Kraus ..... B21D 39/021 72/21.4
2014/0150510 A1 6/2014 Beltran et al.

FOREIGN PATENT DOCUMENTS

EP 1462189 A1 9/2004
EP 1899089 A2 3/2008
KR 100965757 B1 * 6/2010
WO 2013062827 A1 5/2013

OTHER PUBLICATIONS

Machine translation of KR 100965757 B1, Huh, pp. 1-5, translated on Mar. 15, 2018.*

* cited by examiner

HIGH STIFFNESS AND HIGH ACCESS FORMING TOOL FOR INCREMENTAL SHEET FORMING

TECHNICAL FIELD

The disclosed inventive concept relates generally to tools for the incremental forming of sheets of material. More particularly, the disclosed inventive concept relates to tools used to assure dimensional accuracy and accessiblity in incrementally formed workpieces.

BACKGROUND OF THE INVENTION

Several methods of forming sheet metal are known. A common method of forming sheet metal is stamping through the use of a die. However, casting a die is an expensive process. While a popular method of metal forming, the use of a die has certain disadvantages.

A variant of the use of a die in the formation of a metal workpiece is through a deep drawing process. In this process, a sheet metal blank is radially drawn into a forming die through the use of a punch.

Another known method of forming a workpiece is by way of incremental sheet forming. This is a technique where a metal sheet is formed step-wise into a finished workpiece by way of a series of relatively small incremental deformations. Sheet formation is accomplished using a round tipped tool that is typically fitted to a robotic arm. The tool forms the workpiece incrementally by repeated movements until the workpiece is fully formed.

One of the three key performance characteristics that determines the quality of incrementally formed workpieces is "dimensional accuracy." The two main factors that influence dimensional accuracy are spring back of the (sheet metal) workpiece and stiffness of the various elements of the forming machine system. However, known forming tools do not always achieve the desired level of dimensional accuracy because such tools have large shanks that may interfere with formation of the metal workpiece through unintended contact with the vertical walls of the workpiece during the forming process.

Another hindrance to achieving the desired level of dimensional accuracy is that that that known tools have shanks that are tapered to meet the round tip and, as a consequence, the tip-to-shank interface is the weakest point on the load path of the entire forming machine. Known systems are thus prone to breakage at this point caused by stiffness of the forming tool and the inherent weakness of the tip-to-shank interface, a weakness that becomes particularly pronounced when deflection is experienced during the forming process.

Accordingly, finding an efficient and economical solution to mold vehicle interior components using a metallic pigment in the resin that avoids flow marks or dark spots while minimizing wastage is a desirable goal for automotive manufacturers.

SUMMARY OF THE INVENTION

The disclosed inventive concept overcomes the problems associated with known approaches to forming material sheeting. The disclosed inventive concept is a tool for the incremental forming of a sheet of material in which the tool comprises a forming tip, a shank, and an interface adapter positioned between the forming tip and the shank.

The diameter of the forming tip is greater than the diameter of the shank. The forming tip may be of a variety of configurations as best suited for a particular workpiece shape. The forming tip may be donut-shaped. The donut-shaped tip may have a recessed area formed therein. The recessed area may be frustoconically shaped. A forming tool having a single donut-shaped forming tip may be used or, alternatively, a forming tool having multiple donut-shaped forming tips may be used. The diameters of the multiple donut-shaped forming tips are different, whereby a tip having a smaller diameter may be selected for a first pass to contour the workpiece, followed by selection of a tip having a larger diameter and so on until the workpiece is finished. By providing a single forming tool having tips of increasingly large diameters, the same forming tool may be used for multiple passes to contour the workpiece without the need for changing the forming tool.

As an alternative to the forming tip being donut-shaped, the forming tip may be made up of multiple spheres. In a first embodiment of the multiple-sphere variant of the forming tool, spheres having different diameters may be provided, thus allowing a forming tip of a smaller diameter to be used for an initial pass to contour the workpiece. followed by the use of a sphere having a larger diameter. Like the forming tool having multiple donut-shaped forming tips of different sizes, the forming tool having spheres of different sizes allows use of a single forming tool without the need to change forming tools between passes.

In a second embodiment of the multiple-sphere variant of the forming tool, the spheres are all of the same diameter. This forming tool rotates during the workpiece forming process.

Regardless of the embodiment, the forming tool of the disclosed inventive concept provides an efficient and practical method of incremental sheet forming that is devoid of the disadvantages of known approaches. The disclosed inventive concept does not suffer from the possibility of breakage while avoiding the tool shank-to-workpiece interference experienced through the operation of known forming tools.

The above advantages and other advantages and features will be readily apparent from the following detailed description of the preferred embodiments when taken in connection with the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention wherein.

DETAILED DESCRIPTION OF THE PREFERRED EMBODIMENT

Figure 1:
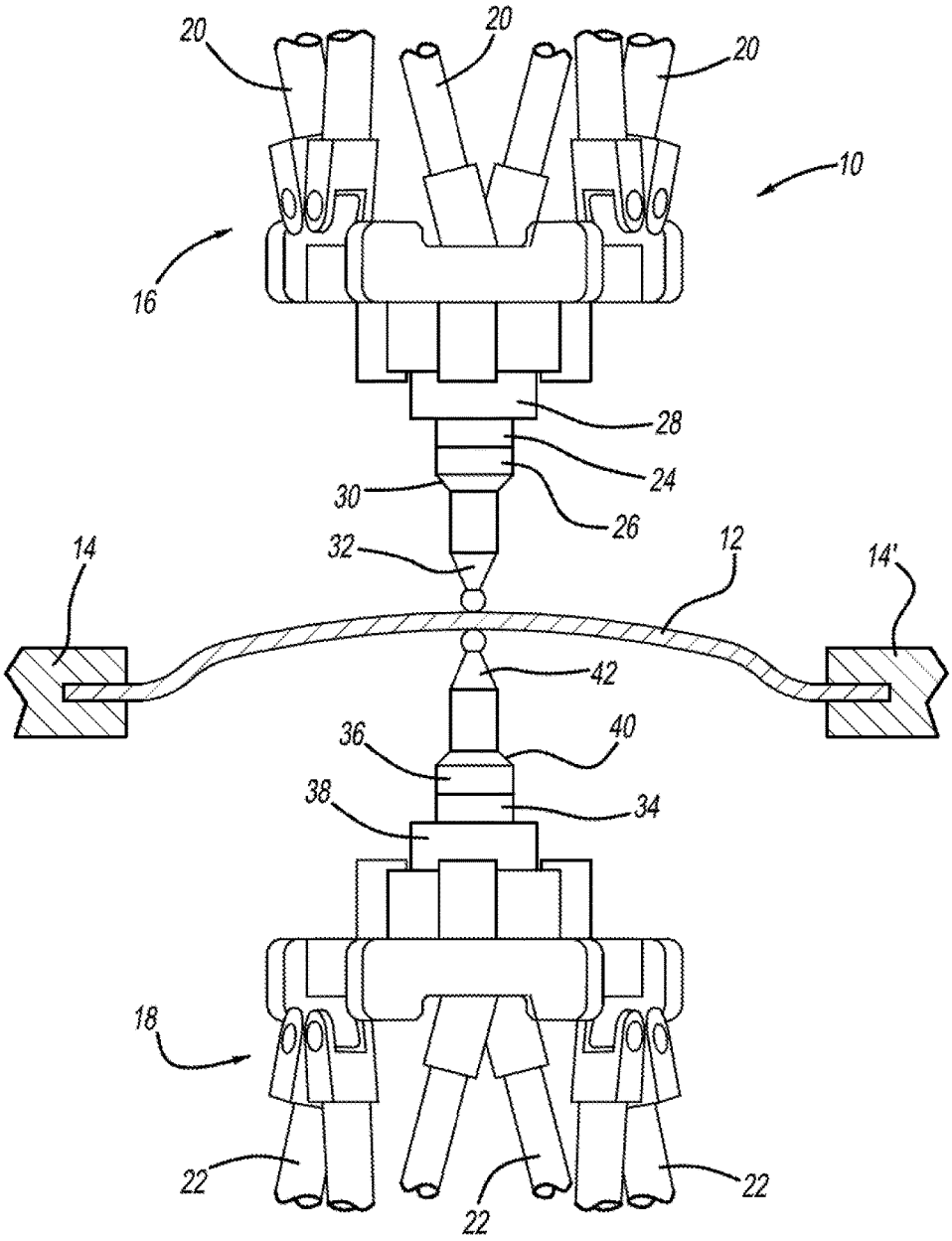
FIG - 1 Prior Art
FIG. 1 is a side view of a known system for incrementally forming a workpiece.

In the following figures, the same reference numerals will be used to refer to the same components. In the following description, various operating parameters and components are described for different constructed embodiments. These specific parameters and components are included as examples and are not meant to be limiting.

Referring to FIG. 1, a known system, generally illustrated as 10, for incrementally forming a workpiece 12 is shown. Such systems are used for forming a variety of formable materials, such as sheet metal. The workpiece 12 may be generally planar or may be at least partially preformed or non-planar in one or more embodiments of the present invention. The system 10 conventionally includes a workpiece support structure 14 and 14' that releasably captures and holds the workpiece 12, a first manipulator 16, and a second manipulator 18. The first manipulator 16 and the second manipulator 18 are operated by a programmable controller (not illustrated). Controller monitors and controls operation of the manipulators, the load cell, the heating element, arm and tool changer.

The first manipulator 16 and the second manipulator 18 are provided to position forming tools. The first manipulator 16 and the second manipulator 18 are mounted on separate platforms (not shown). The first manipulator 16 and the second manipulator 18 can have the same or different configurations, such as having multiple degrees of freedom. For example, hexapod manipulators may have at least six degrees of freedom such as the Fanuc Robotics model F-200i hexapod robot.

The manipulator 16 includes a series of links or struts 20 joined to a platform. The manipulator 18 includes a series of links or struts 22 joined to a platform. The links or struts 20 and 22 are typically linear actuators, such as hydraulic cylinders. A manipulator having six degrees of freedom may move in three linear directions and three angular directions singularly or in any combination. Thus the manipulators 16 and 18 can move an associated tool along a plurality of axes, such as X. Y and Z axes.

The first manipulator 16 may include a load cell 24, a heating element 26, an arm 28, a tool holder 30, and a forming tool 32. The second manipulator 18 may include a load cell 34, a heating element 36, an arm 38, a tool holder 40, and a forming tool 42.

The load cells 24 and 34 detect force exerted on the workpiece 12. Data generated by the load cells 24 and 34 are communicated to the controller for minotiring and controlling operation of the system 10.

The heating elements 26 and 36 provide energy that is transmitted to the workpiece 12 to enhance the desired forming of the workpiece 12. The heating elements 26 and 36 may be electrical or non-electrical and may be used to provide heat directly (such as by laser) or indirectly (such as by conduction) to the workpiece 12.

The arms 28 and 36 are provided to rotate the tool holders 30 and 40 respectively. The arms 28 and 38 may be actively controlled by programming or controlled rotation. Alternatively, the arms 28 and 38 may be passively controlled by allowing free rotation of the arms 28 and 38 in response to force exerted against the workpiece 12, such as force transmitted by the forming tools 32 and 42.

The tool holders 30 and 40 receive and hold the forming tools 32 and 42 respectively. Each of the tool holders 30 and 40 includes an aperture to receive a portion of the forming tools 32 and 42 and secure the forming tools 32 and 42 in a fixed position with a clamp, set screw, or other mechanism as is known in the art. Alternatively, the tool holders 30 and 40 and/or forming tools 32 and 42 may also be associated with an automated tool changer (not shown) that may allow for rapid interchange or replacement of tools.

The system 10 is used to incrementally form a workpiece. According to the method of incremental forming, the workpiece 12 is formed into a desired configuration by a series of small, incremental deformations. The small incremental deformations are made by moving the forming tools 32 and 42 against the surface of the workpiece 12. Movement of the forming tools 32 and 42 may occur along a path programmed into the controller. Alternatively, the path of movement of the forming tools 32 and 42 may also be adaptively programmed in real-time based on measured feedback, such as from the load cells 24 and 34. According to this method, forming occurs incrementally as the forming tools 32 and 42 are moved along the workpiece 12.

Figure 2:
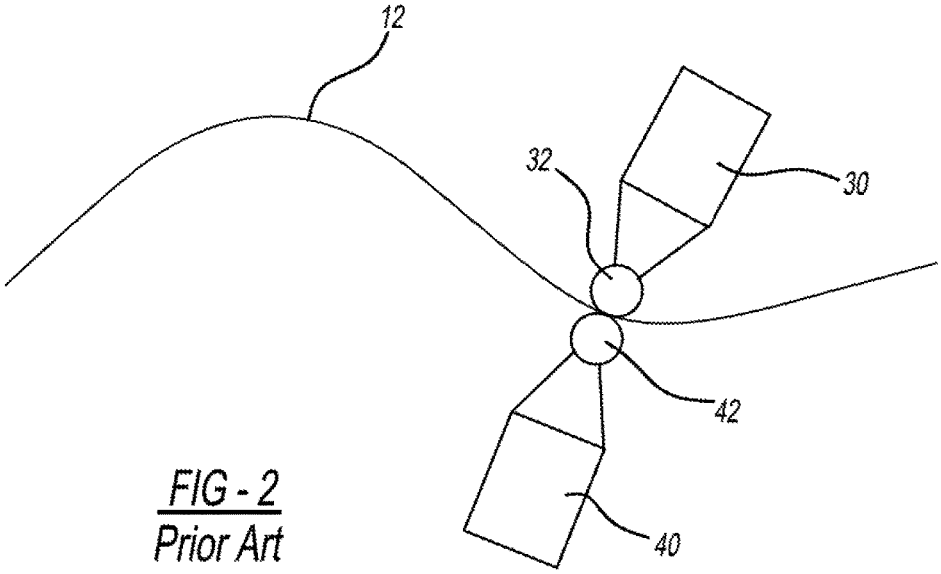
FIG - 2 Prior Art
FIG. 2 is a side view of a workpiece being formed by opposing forming tools according to a known arrangement.
Figure 3:
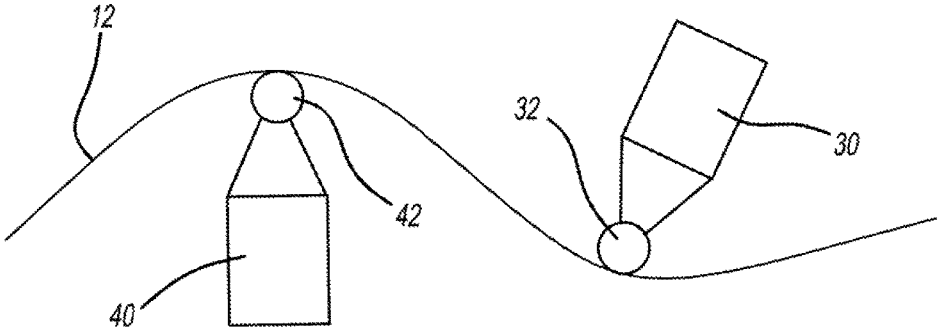
FIG - 3 Prior Art
FIG. 3 is a side view of a workpiece being formed by spaced apart forming tools according to a known arrangement.

The forming tools 32 and 42 impart shaping force for the formation of the workpiece 12. According to known techniques, the workpiece 12 may be formed through operation of two opposed forming tools 32 and 42 as illustrated in FIG. 2 or through the operation two spaced apart forming tools 32 and 42 as illustrated in FIG. 3. When the forming tools 32 and 42 operate in opposition as illustrated in FIG. 2, the workpiece 12 is shaped through the simultaneous movement of the tools. Alternatively, the workpiece 12 may be formed by simultaneous operation of the forming tools 32 and 42 when the tools are positioned not in opposition but at spaced apart locations as illustrated in FIG. 3.

While achieving certain objectives, known forming tools such as forming tools 32 and 42 fail to overcome known and consistent challenges when used in production. These weaknesses are inherent in the design and construction of known forming tools themselves.

Figure 4:
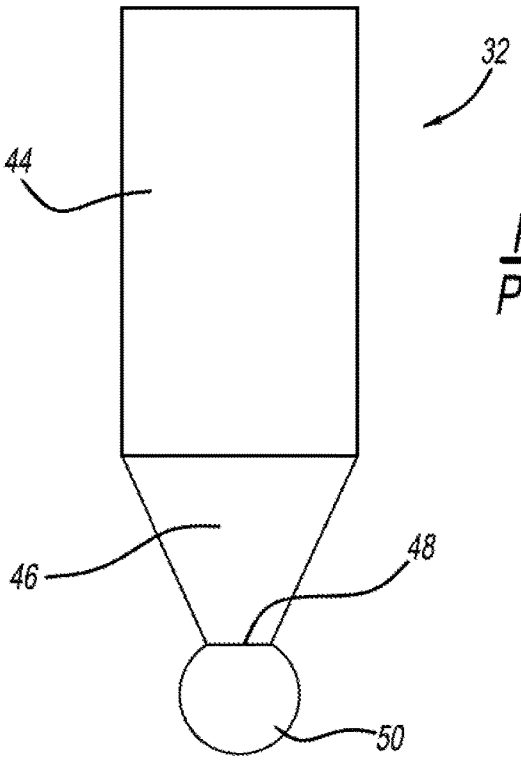
FIG - 4 Prior Art
FIG. 4 is a side view of an incremental forming tool according to the prior art.

Referring to FIG. 4, a side view of the incremental forming tool 32 shown in FIGS. 1 through 3 is illustrated. The forming tool 32 includes a shank 44, a transition 46, a neck 48, and a solid ball end or forming tip 50. The neck 48 defines the tip-to-shank interface. The transition 46 is known to have both conical or non-conical shapes, though a conical transition 46 is illustrated.

Figure 5A:
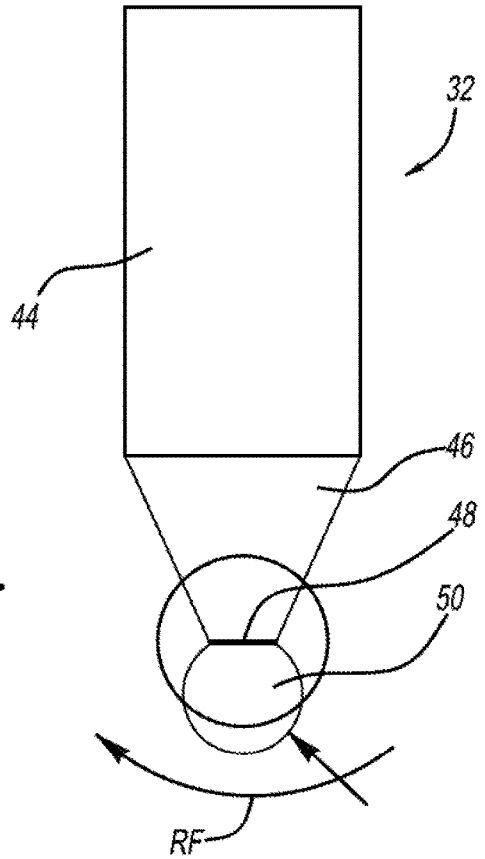
FIG - 5A Prior Art
FIG. 5A is a side view of an incremental forming tool according to the prior art illustrating the revolving force and consequent stress placed on the joint between the tapered portion of the tool shank and the rounded tip.
Figure 5B:
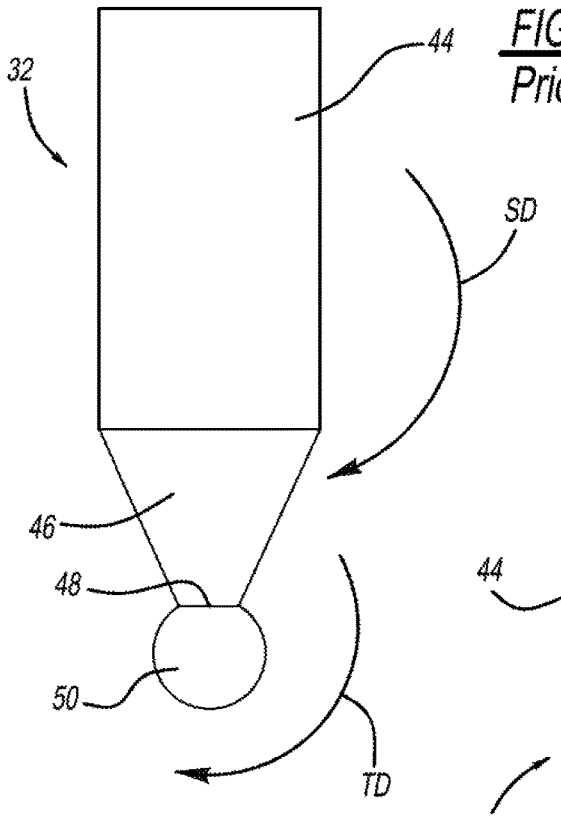
FIG - 5B Prior Art
FIG. 5B is a side view of an incremental forming tool according to the prior art illustrating the shank deflection and the tip deflection of the tool.

As illustrated in FIG. 5A, known incremental forming tools are structurally weakest within the load path of the forming machine (system), because they are the physically smallest element in the system. This is especially true at the interface between the forming tip 50 and the transition 46. Forming forces, such as the revolving force RF shown in FIG. 5A and the shank deflection SD and tip deflection TD shown in FIG. 5B are transferred entirely through these smaller sections when the workpieces are being formed making them subjected to the highest stresses.

Figure 5C:
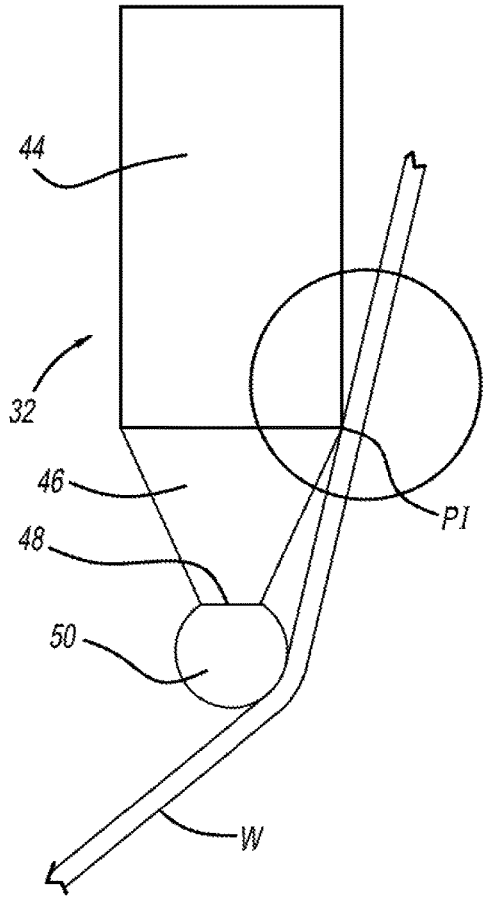
FIG - 5C Prior Art
FIG. 5C is a side view of an incremental forming tool according to the prior art illustrating the tool shank-to-workpiece interference.

As is known in the prior art, smaller tip diameters are more common than their larger counterparts because they can form fillets, small features and sharp corners. However, the need to use smaller tips poses certain problems in production. First, the diameter of the interface of the neck 48 between the forming tip 50 and the shank 44 is smaller than the diameter of the ball-end as is illustrated in FIGS. 4 through 5C. For example, the neck of a 6 mm diameter tool tip may be not more than 4 mm. When higher loads are applied, the stresses at the interfaces can become extremely high resulting both elastic and possibly plastic deformation as shown in FIGS. 5A and 5B. Second, any elastic deformation at the forming tip 50 will cause dimensional inaccuracies of the workpiece. Third, any plastic deformations will cause permanent damage to the forming tool 32.

Other problems associated with known forming tools are known. For example, the forces rotating about the tool axes (as shown in FIG. 5A) may cause the forming tip 50 to break away from the transition 46 at the neck 48 due to fatigue. In addition, forming tools 32 having smaller forming tips 50 have smaller shanks 44 to avoid interference with the workpiece during formation. The shanks 44 are cantilevers with the forces applied at the end. Tool deflections become more significant that can affect dimensional accuracy, as the shank length becomes longer and diameter becomes smaller as indicated in FIGS. 5A and 5B.

Furthermore, the diameter of the shank 44 relative to the diameter of the forming tip 50 dictates the maximum forming angle. Accordingly, and as illustrated in FIG. 5C, any areas of the workpiece that have slopes greater than the maximum forming angle will interfere with the shank 44. As illustrated, there is an area of physical interference PI caused during formation of the workpiece W when the lower end of the shank 44 contacts the workpiece W. In the area of physical interference PI, the shank impacts against the workpiece W resulting in unsatisfactory formation of the workpiece W. As is illustrated in FIGS. 4 through 5A, the prior art approaches to providing an incremental forming tool suffer from certain disadvantages.

Figure 8A:
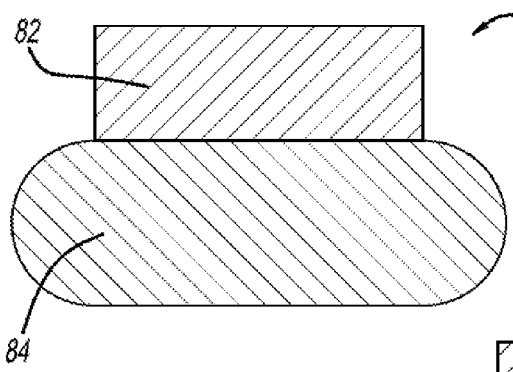
FIG. 8A is a sectional view of a first tip configuration of an incremental forming tool according to the disclosed inventive concept.
Figure 9A:
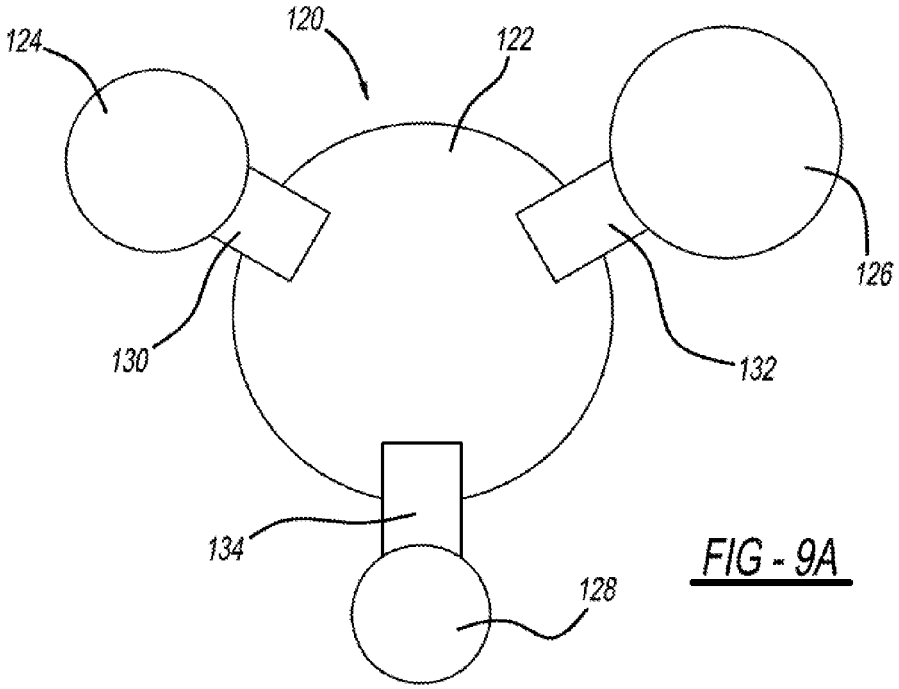
FIG. 9A is an underside view of a multi-tipped rotating tool according to the disclosed inventive concept wherein the tips are donut-shaped and are of different diameters.
Figure 9B:
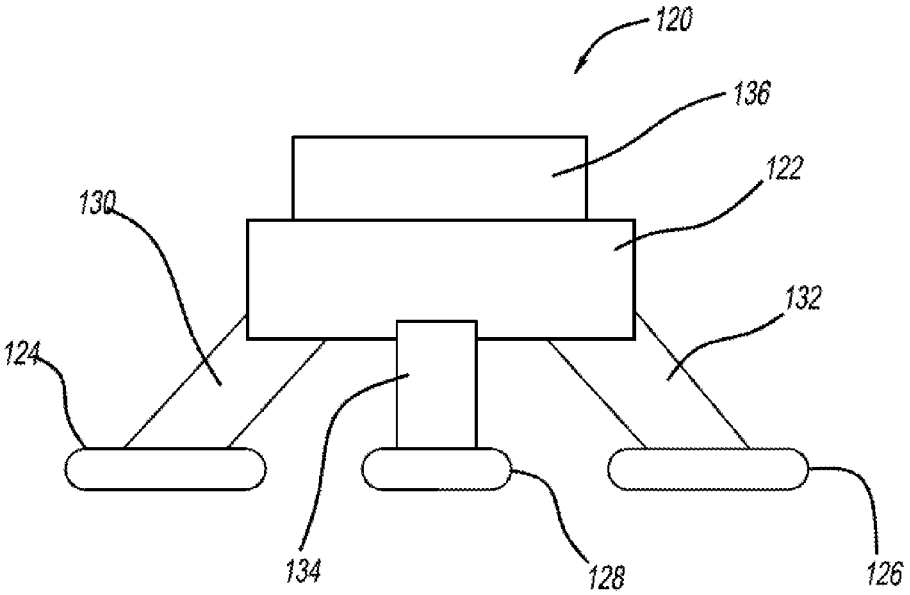
FIG. 9B is a side view of the multi-tipped rotating tool of FIG. 9A according to the disclosed inventive concept.
Figure 10A:
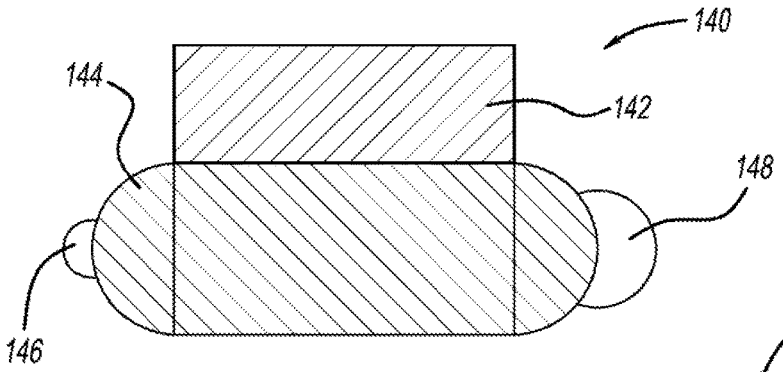
FIG. 10A is a sectional view of a multi-ball tip rotating tool according to the disclosed inventive concept wherein the spherical tips are of different diameters.
Figure 10B:
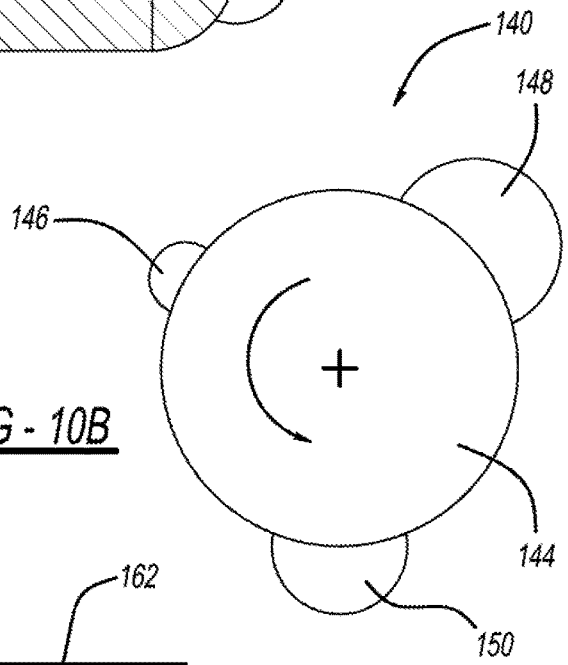
FIG. 10B is an underside view of the multi-ball tip rotating tool of FIG. 10A according to the disclosed inventive concept.
Figure 11A:
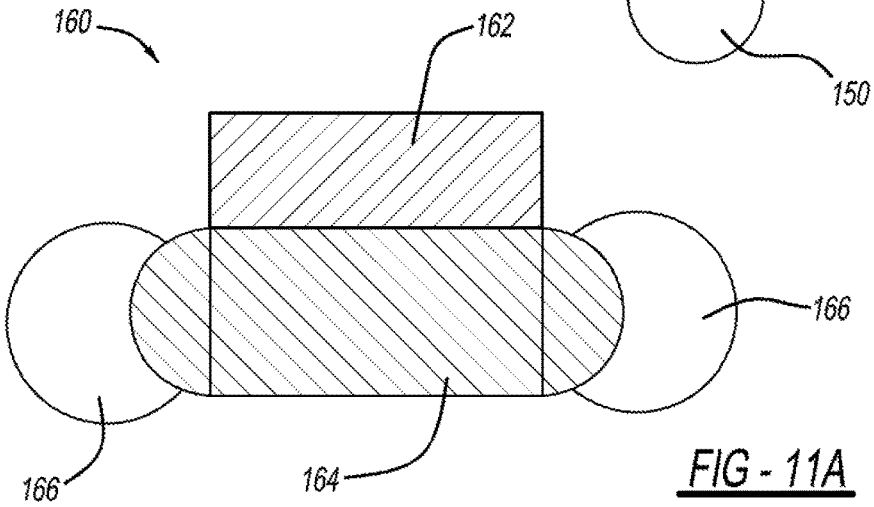
FIG. 11A is a sectional view of another multi-ball tip rotating tool according to the disclosed inventive concept wherein the tips are the same diameter.
Figure 11B:
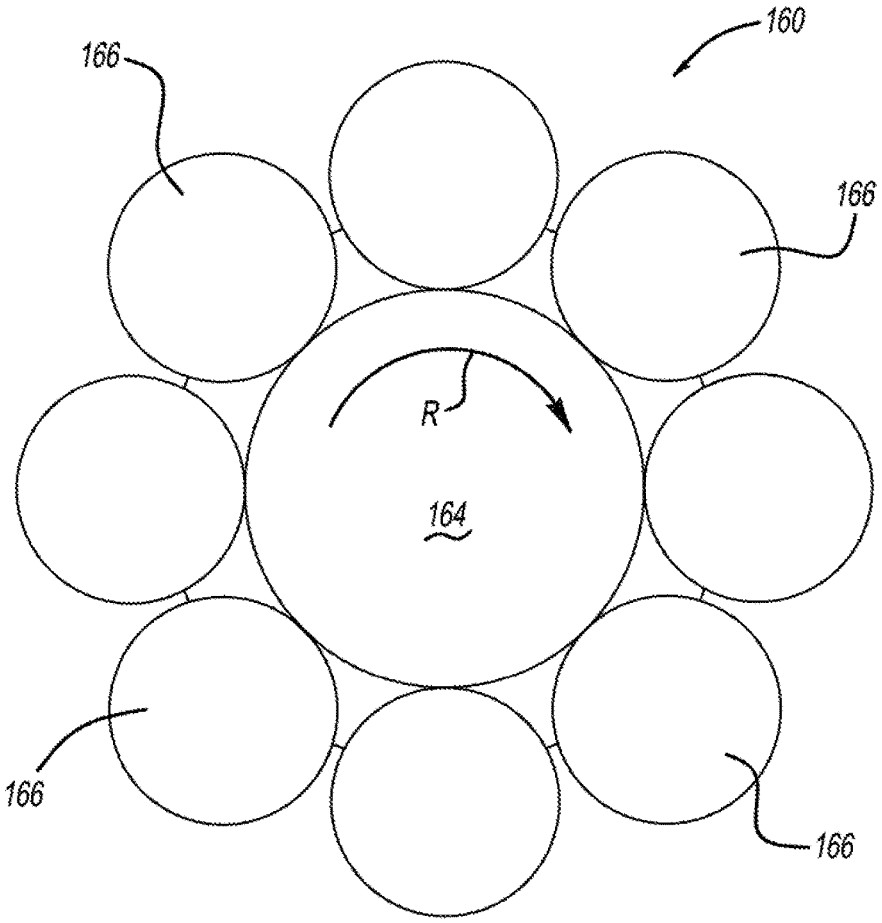
FIG. 11B is an underside view of the multi-ball tip rotating tool of FIG. 11A according to the disclosed inventive concept.

The disclosed inventive concept overcomes the challenges faced by known incremental forming tools. Four general embodiments are illustrated in the figures and are discussed in relation thereto. FIGS. 6 through 8D illustrate a first embodiment. FIGS. 9A and 9B illustrate a second embodiment. FIGS. 10A and 10B illustrate a third embodiment. FIGS. 11A and 11B illustrate a fourth embodiment.

Referring to FIGS. 6 through 8D, variations of the first embodiment of the disclosed inventive concept are illustrated. The common features of the illustrated variations of the incremental forming tool include a shank for attachment to a unit such as a CNC machine or a robotic arm, donut-shaped forming tool, and an adaptor that functions as the interface between the shank and the donut-shaped forming tool. While three individual components are illustrated, it is to be understood that the incremental forming tool of FIGS. 6 through 8D may be formed from a solid piece. The forming tool of the disclosed inventive concept may be used for forming any suitable material or materials that have desirable forming characteristics, such as a metal, metal alloy, polymeric material, or combinations thereof.

The most important feature of the incremental forming tool of FIGS. 6 through 8D is the use of the donut-shaped component as the forming element instead of the ball-end tip of the prior art. This design provides several advantages of the prior art. The incremental forming tool of FIGS. 6 through 8D is of extremely rigid construction with very little elastic deformation and no plastic deformation at the tip (defined by the illustrated donut shape). This configuration provides an optimum balance of tool stiffness required to form hard workpiece material and structural integrity that is strong enough to prevent breakage. Accordingly, the disclosed inventive concept overcomes the limitation of known forming tools that suffer breakage if too stiff and thus cannot be effectively or economically used to form workpieces composed of hard material. The donut itself can be made as large as needed for a particular application. The diameter of the shank can be made as large as the outer diameter of the donut, thus making the shank extremely rigid. The flat underside of the donut-shaped tips provides improved dimensional accuracy during the forming process.

Other advantages of the incremental forming tool of FIGS. 6 through 8D include a reduced chance of fatigue fracture due to lower stresses and the fact that the shank does not interfere with the workpiece being formed as long as the shank is equal or less than the outside diameter of the donut. When viewed in cross-section, the donut circular, elliptical or any other shape that might be optimal for the workpiece being formed. The donut itself may be produced from a high hardness material such as tool steel, tungsten or tungsten carbide that is different from the material for making the adaptor and the shank. The donut may also be coated without having to coat the adaptor or the shank. Finally, the incremental forming tool of FIGS. 6 through 8D results in improved formability of the workpiece as a result of putting more energy at the point of contact because of the increased linear speed at the point of forming.

Figure 6:
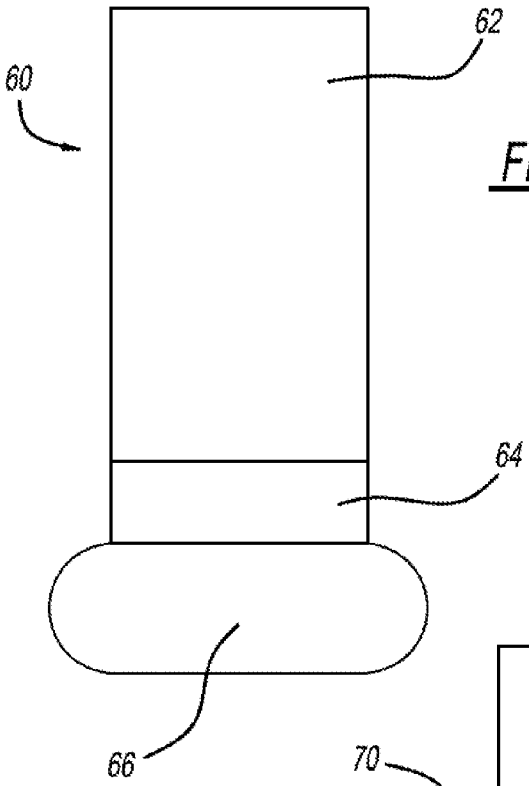
FIG. 6 is a side view of an incremental forming tool according to the disclosed inventive concept illustrating the shank, the forming tip, and an interface adapter.

Referring to FIG. 6, a side view of an incremental forming tool according to the disclosed inventive concept is shown and is generally illustrated as 60. The incremental forming tool 60 includes a shank 62, an interface adapter 64, and a donut-shaped forming tip 66.

Figure 7:
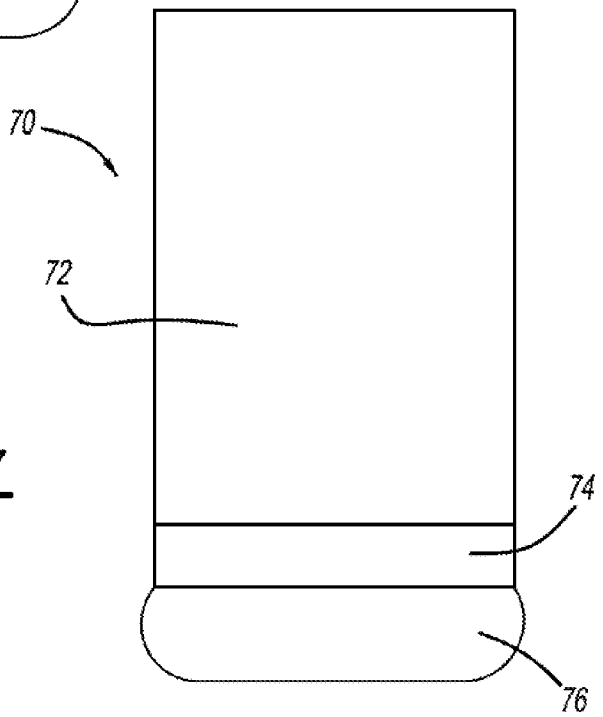
FIG. 7 is a side view of an additional embodiment of the incremental forming tool according to the disclosed inventive concept illustrating the shank, the forming tip, and an interface adapter.

Referring to FIG. 7, a side view of an incremental forming tool according to the disclosed inventive concept is shown and is generally illustrated as 70. The incremental forming tool 70 includes a shank 72, an interface adapter 74, and a donut-shaped forming tip 76.

The donut-shaped forming tips 66 and 76 may be of a variety of shapes and sizes. Some of these various configurations are illustrated in FIGS. 8A through 8D. Referring to FIG. 8A, a sectional view of an incremental forming tool according to the disclosed inventive concept is illustrated and is generally illustrated as 80. The incremental forming tool 80 includes a shank 82 and a donut-shaped forming tip 84. As illustrated, the donut-shaped forming tip 84 is solid.

Figure 8B:
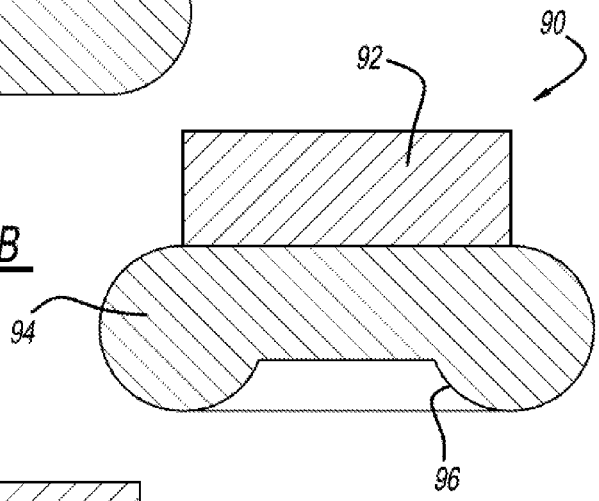
FIG. 8B is a sectional view of a second tip configuration of an incremental forming tool according to the disclosed inventive concept.

Referring to FIG. 8B, a sectional view of an incremental forming tool according to the disclosed inventive concept is illustrated and is generally illustrated as 90. The Incremental forming tool 90 includes a shank 92 and a donut-shaped forming tip 94. The donut-shaped forming tip 94 has an underside recessed area 96 having a frustoconical shape.

Figure 8C:
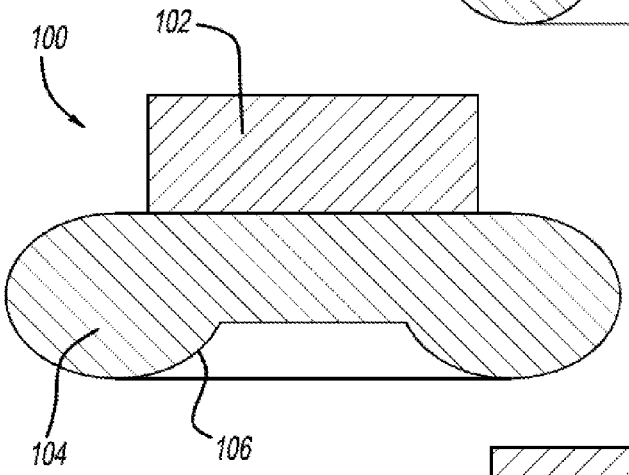
FIG. 8C is a sectional view of a third tip configuration of an incremental forming tool according to the disclosed inventive concept.

Referring to FIG. 8C, a sectional view of an incremental forming tool according to the disclosed inventive concept is Illustrated and is generally illustrated as 100. The incremental forming tool 100 includes a shank 102 and a donut-shaped forming tip 104 that is similar to, but not the same as, the donut-shaped forming tip 104 of the embodiment shown in FIG. 8B in that the donut-shaped forming tip 104 is wider than the donut-shaped forming tip 94. The donut-shaped forming tip 104 has an underside recessed area 106 having a frustoconical shape.

Figure 8D:
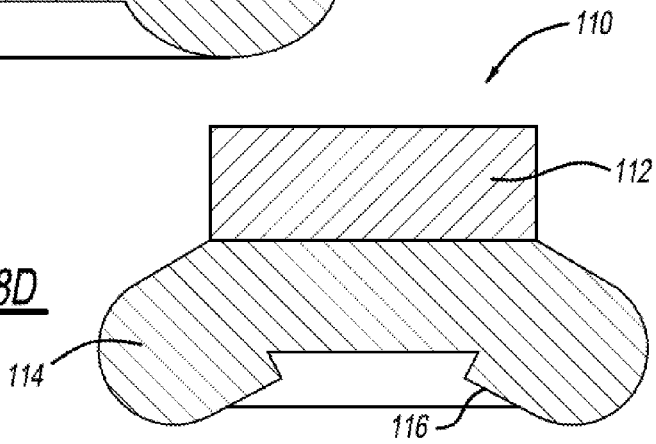
FIG. 8D is a sectional view of a fourth tip configuration of an incremental forming tool according to the disclosed inventive concept.

Referring to FIG. 8D, a sectional view of an incremental forming tool according to the disclosed inventive concept is illustrated and is generally illustrated as 110. The incremental forming tool 110 includes a shank 112 and a donut-shaped forming tip 114. The donut-shaped forming tip 114 has an angled upper surface not present on the donut-shaped forming tip 94 and 104. The donut-shaped forming tip 114 has an underside recessed area 114 having a frustoconical shape that is more complex than the shapes of the recessed areas 96 and 106.

FIGS. 9A and 9B illustrate the second embodiment of the disclosed inventive concept. As illustrated in these figures, a multi-tip forming tool, generally illustrated as 120, is shown. The multi-tip forming tool 120 includes an adapter 122 to which a plurality of donut-shaped metal forming tips, including donut-shaped tip 124, donut-shaped tip 126, and donut-shaped tip 128 are attached. The donut-shaped tip 124 is attached to the adapter 122 by an arm 130. The donut-shaped tip 126 is attached to the adapter 122 by an arm 132. The donut-shaped tip 128 is attached to the adapter 122 by an arm 134. The adapter 122 is attached to a shank 136. The arms 130, 132 and 134 function as positioning axes.

The donut-shaped tips 124, 126 and 128 according to this embodiment are of different diameters. For example, the donut-shaped tips 124, 126 and 128 can range from 6 mm to 25 mm in diameter. By providing a single forming tool 120 having tips of different sizes, the need for changing forming tools during the forming operation is avoided as the smaller tip 128 may be used for the first contouring pass on the workpiece, the intermediate-sized tip 124 may be selected for the second pass, and the largest tip 126 may be selected for the final pass.

FIGS. 10A and 10B illustrate the third embodiment of the disclosed inventive concept. As illustrated in these figures, a multi-ball tip forming tool, generally illustrated as 140, is shown. The multi-ball tip forming tool 140 includes a shank 142 to which is attached a donut-shaped body 144. Extending outwardly from the donut-shaped body 144 is a plurality of metal forming ball-end tips, including ball-end tip 146, ball-end tip 148, and ball-end tip 150. The ball-end tips 146, 148, and 150 are of different diameters. For example, the ball-end tips 146, 148 and 150 can range from 6 mm to 25 mm in diameter. By providing a single forming tool 140 having tips of different sizes, the need for changing forming tools during the forming operation is avoided as the smaller ball-end tip 146 may be used for the first contouring pass on the workpiece, the intermediate-sized ball-end tip 150 may be selected for the second pass, and the largest ball-end tip 148 may be selected for the final pass.

The forming tool 120 of FIGS. 9A and 9B and the forming tool 140 of FIGS. 10A and 10B offer several advantages over the prior art, including many of those of the forming tool of FIGS. 6 through 8D. The tips can be made of a high hardness material that is different from the adaptor and shank (they can be coated without having to coat the adaptor and the shank) as well as the improved formability of the workpiece as a result of putting more energy at the point of contact because of the increased linear speed at the point of forming.

FIGS. 11A and 11B illustrate the fourth embodiment of the disclosed inventive concept. As illustrated in these figures, a multi-ball tip rotating and pulsating forming tool, generally illustrated as 160, is shown. The multi-ball tip rotating forming tool 160 forming tool includes a shank 162 to which is attached a donut-shaped body 164. Extending outwardly from the donut-shaped body 164 is a plurality of metal forming ball-end tips 166, preferably of the same diameter. On rotation in a rotational direction R, the multi-ball tip rotating forming tool 160 effectively incrementally forms the metal workpiece by emulating pulsation which can lead to improved formability.

Regardless of the embodiment, the rotating forming tool of the disclosed inventive concept provides an efficient and practical method of incremental sheet forming that is devoid of the disadvantages of known approaches. The disclosed inventive concept does not suffer from the possibility of breakage between the forming tip and the transition as is known in the art because of the diameter of the forming tool tip compared with the shank. Because of the improved design, forces as large as 8 kN may be applied. Furthermore, the disclosed inventive concept avoids the tool shank-to-workpiece interference experienced through the operation of prior art forming tools.

One skilled in the art will readily recognize from such discussion, and from the accompanying drawings and claims that various changes, modifications and variations can be made therein without departing from the true spirit and fair scope of the invention as defined by the following claims.

What is claimed is:

1. A tool for an incremental forming of a sheet of material, the tool comprising:

an adapter having a first diameter, said adapter having an outer periphery;

a shank to which said adapter is attached, said shank having a second diameter, said first diameter of said adapter being greater than said second diameter of said shank; and a first and a second ball-end tip directly attached to said outer periphery of said donut-shaped adapter, each of said ball-end tips having a different diameter, wherein said adapter and said first and second ball-end tips lie in a first axial plane, wherein said shank and said adapter lie in a second axial plane, said first and second axial planes being perpendicular to one another.

2. The tool for an incremental forming of a sheet of material of claim 1, wherein the diameters of each ball-end tip range from 6 mm to 25 mm.

3. The tool for an incremental forming of a sheet of material of claim 1, further comprising a third ball-end tip directly attached to said outer periphery of said adapter.

4. The tool for an incremental forming of a sheet of material of claim 3, wherein the diameters of each ball-end tip range from 6 mm to 25 mm.

* * * * *